US010791386B2

(12) United States Patent
Schalla et al.

(10) Patent No.: US 10,791,386 B2
(45) Date of Patent: Sep. 29, 2020

(54) METHOD OF MANUFACTURING A COMPOSITE PANEL

(71) Applicant: The Boeing Company, Chicago, IL (US)

(72) Inventors: James Schalla, Chicago, IL (US); Jeff Duce, Chicago, IL (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/117,116

(22) Filed: Aug. 30, 2018

(65) Prior Publication Data

US 2018/0376229 A1 Dec. 27, 2018

Related U.S. Application Data

(60) Division of application No. 14/994,863, filed on Jan. 13, 2016, now Pat. No. 10,091,567, which is a continuation-in-part of application No. 14/940,241, filed on Nov. 13, 2015, now Pat. No. 10,118,547.

(51) Int. Cl.

| | |
|---|---|
| ***H04R 31/00*** | (2006.01) |
| ***H04R 1/02*** | (2006.01) |
| *H04R 27/00* | (2006.01) |

(52) U.S. Cl.

CPC ..... *H04R 1/025* (2013.01); *H04R 1/028* (2013.01); *H04R 27/00* (2013.01); *H04R 2201/021* (2013.01); *H04R 2499/13* (2013.01)

(58) Field of Classification Search

CPC ..... H04R 1/028; H04R 1/025; H04R 27/00
See application file for complete search history.

(56) References Cited

U.S. PATENT DOCUMENTS

| | | | | |
|---|---|---|---|---|
| 7,743,659 | B2 * | 6/2010 | Kearns | G01M 5/00 73/632 |
| 7,857,484 | B2 | 12/2010 | Marshall et al. | |
| 8,033,684 | B2 | 10/2011 | Marshall et al. | |
| 9,154,862 | B2 | 10/2015 | Cheung | |
| 2005/0002197 | A1 | 1/2005 | Kohlmeier-Beckmann et al. | |
| 2005/0023974 | A1 * | 2/2005 | Chwang | H01L 51/5253 313/512 |

(Continued)

FOREIGN PATENT DOCUMENTS

| | | |
|---|---|---|
| DE | 19811076 | 9/1999 |
| WO | WO 2015/017198 | 2/2015 |

*Primary Examiner* — Paul D Kim
(74) *Attorney, Agent, or Firm* — McDonnell Boehnen Hulbert & Berghoff LLP

(57) ABSTRACT

Embedded lighting, microphone, and speaker features for composite panels are described. An example composite panel includes a plurality of plies assembled in a stack-up, and a trace sheet with electrically conductive traces and a plurality of transducer discs positioned onto the electrically conductive traces at positions such that the electrically conductive traces form an electrical interconnection between selected ones of the electrically conductive traces and associated ones of the transducer discs. The trace sheet is included as an internal ply in the stack-up of the plurality of plies. The composite panel also includes a composite base upon which the stack-up of the plurality of plies is applied, and the plurality of plies are cured upon the composite base to integrate the trace sheet and the plurality of transducer discs into the composite base.

20 Claims, 10 Drawing Sheets

(56) References Cited

U.S. PATENT DOCUMENTS

| | | | |
|---|---|---|---|
| 2007/0003733 | A1 | 1/2007 | Muller |
| 2008/0289426 | A1 | 11/2008 | Kearns et al. |
| 2012/0140126 | A1 | 6/2012 | Werth et al. |
| 2015/0167956 | A1 | 6/2015 | Vaidya |
| 2016/0176163 | A1 | 6/2016 | Brown et al. |
| 2017/0142523 | A1 | 5/2017 | Schalla et al. |

* cited by examiner

METHOD OF MANUFACTURING A COMPOSITE PANEL

CROSS REFERENCE TO RELATED PATENT APPLICATION

The present disclosure claims priority to and is a divisional of U.S. patent application Ser. No. 14/994,863, filed on Jan. 13, 2016, now U.S. Pat. No. 10,091,567, which is a continuation-in-part of U.S. patent application Ser. No. 14/940,241, filed on Nov. 13, 2015, now U.S. Pat. No. 10,118,547, the entire contents of each of which are herein incorporated by reference.

FIELD

The present disclosure generally relates to interior lighting panels for passenger aircraft, and more particularly, to aircraft ceiling, stow bin, valences, sidewalls or other mounted lighting panels adapted to display a starry nighttime sky effect. The present disclosure also relates to composite panels including printed microphones or loud-speakers, and more particularly, to interior panels for passenger vehicles (e.g., aircraft) or to other walls within conference rooms for panels adapted to integrate a printed sheet of microphones and loud-speakers, and/or light sources, and further to other structures such as a table or a phone case/cover to integrate the printed sheet.

BACKGROUND

Passenger aircraft that operate over long distances during the night typically include interior lighting arrangements that provide substantially reduced ambient light so that passengers can sleep comfortably, but which is still bright enough to enable those passengers who choose not to sleep to move about the cabin safely. For example, some models of passenger jets incorporate ceiling panels that incorporate light emitting diodes (LEDs) arranged so as to blink in random patterns against a gray or dark blue background, and which, in a reduced ambient light condition, gives the relaxing, soporific appearance of a starry nighttime sky, and hence, is referred to as a "Starry Sky" ceiling lighting arrangement.

A conventional Starry Sky lighting panel may include complex discrete wiring and electrical components located on a back surface thereof. The panel may use lenses, lens holders, hardwired LEDs, and wire bundles deployed on individual standoffs, and discrete power conditioning and control components that are integrated in a relatively complicated manufacturing process to produce a panel that gives the desired effect. In a typical installation, the aircraft may contain many of such panels, each of which may contain many LEDs. A typical Starry Skies ceiling panel feature requires the LEDs to be manually installed in the panel.

In addition, typically microphones and speakers are also installed in a ceiling panel of aircraft to enable communication with passengers.

The disadvantages and limitations of these solutions are that the method of producing the panel is costly and relatively heavy, requires intensive, ergonomically costly manual labor steps due to the amount of manually installed wire, takes up a relatively large volume behind the ceiling panels and is difficult to retrofit into existing aircraft. Because of the mass and volume of the wires for this system, it is typically limited to only be installed in ceilings.

In light of the foregoing, there is a need in the relevant industry for an aircraft ceiling lighting panel that provides a Starry Sky effect through a "solid state" method that does not use lenses, lens holders, wired LEDs and complex associated point-to-point wiring, reduces panel weight, volume, manual fabrication and assembly labor and cost, eliminates repetitive injuries, and which can easily be retrofitted into existing aircraft.

There is also a need in the relevant industry for an ability to seamlessly integrate microphones and/or loud-speakers into panels that avoids complex associated point-to-point wiring, reduces panel weight, volume, and manual fabrication and assembly labor and cost.

SUMMARY

In one example, a lighting panel is described comprising a substrate having a planar surface, a plurality of electrically conductive traces printed onto the planar surface of the substrate, and a plurality of light sources mounted onto the plurality of electrically conductive traces on the planar surface of the substrate at mounting positions such that the plurality of electrically conductive traces form an electrical interconnection between selected ones of the plurality of electrically conductive traces and associated ones of the plurality of light sources. The lighting panel includes a polymer sheet provided over the plurality of light sources, and a composite base upon which a stack-up of the substrate with the printed plurality of electrically conductive traces, the plurality of light sources mounted on the planar surface, and the polymer sheet is applied. The plurality of light sources are embedded into the composite base and are also flush with a top surface of the stack-up, and the substrate is also embedded into the composite base underneath the plurality of light sources at the mounting positions.

In another example, a method of manufacturing a lighting panel is described. The method comprises printing a plurality of electrically conductive traces onto a planar surface of a substrate, mounting a plurality of light sources onto the plurality of electrically conductive traces on the planar surface of the substrate at mounting positions such that the plurality of electrically conductive traces form an electrical interconnection between selected ones of the plurality of electrically conductive traces and associated ones of the plurality of light sources, providing a polymer sheet over the plurality of light sources, and providing a stack-up of the substrate with the printed plurality of electrically conductive traces, the plurality of light sources mounted on the planar surface, and the polymer sheet onto a composite base. The method also includes applying pressure and heat to the stack-up and the composite base to embed the plurality of light sources into the composite base so as to be flush with a top surface of the stack-up, and to embed the substrate into the composite base underneath the plurality of light sources at the mounting positions.

In another example, a composite panel is described that comprises a plurality of plies assembled in a stack-up, and a trace sheet with electrically conductive traces and a plurality of transducer discs positioned onto the electrically conductive traces at positions such that the electrically conductive traces form an electrical interconnection between selected ones of the electrically conductive traces and associated ones of the transducer discs. The trace sheet is included as an internal ply in the stack-up of the plurality of plies. The composite panel also comprises a composite base upon which the stack-up of the plurality of plies is applied, and the plurality of plies are cured upon the composite base to integrate the trace sheet and the plurality of transducer discs into the composite base.

Within examples, the transducer discs may include microphone discs or loud-speaker discs. In one example, the transducer discs may include acoustic-to-electric transducers that convert sound into an electrical signal as a microphone. In another example, the transducer discs include electroacoustic transducers that convert an electrical audio signal into a corresponding sound as a loud-speaker. And, in yet another example, some of the transducer discs may include acoustic-to-electric transducer discs as microphones and some of the transducer discs may include electroacoustic transducers as loud-speakers.

In another example, a method of manufacturing a composite panel is described that comprises printing electrically conductive traces onto a planar surface of a trace sheet, positioning a plurality of transducer discs onto the electrically conductive traces at positions such that the electrically conductive traces form an electrical interconnection between selected ones of the electrically conductive traces and associated ones of the transducer discs, and positioning a stack-up of a plurality of plies onto a composite base. The plurality of plies includes the trace sheet with the printed electrically conductive traces and the plurality of transducer discs, and the trace sheet is included as an internal ply in the stack-up of the plurality of plies. The method also includes applying pressure and heat to the stack-up and the composite base to cure the plurality of plies upon the composite base and to integrate the trace sheet and the plurality of transducer discs into the composite base.

The features, functions, and advantages that have been discussed can be achieved independently in various embodiments or may be combined in yet other embodiments further details of which can be seen with reference to the following description and drawings.

BRIEF DESCRIPTION OF THE FIGURES

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Figure 1:
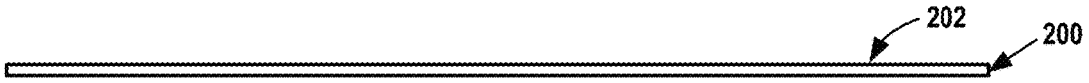
FIG. 1 illustrates a portion of an example process for manufacturing a lighting panel, in which a substrate is shown that has a planar surface, according to an example embodiment.

Disclosed embodiments will now be described more fully hereinafter with reference to the accompanying drawings, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

Within examples, a lighting panel and a method of manufacturing a lighting panel are described. The lighting panel comprises a substrate having a planar surface, a plurality of electrically conductive traces printed onto the planar surface of the substrate, and a plurality of light sources mounted onto the plurality of electrically conductive traces on the planar surface of the substrate at mounting positions such that the plurality of electrically conductive traces form an electrical interconnection between selected ones of the plurality of electrically conductive traces and associated ones of the plurality of light sources. A polymer sheet can be provided over the plurality of light sources. A composite base is provided upon which a stack-up of the substrate with the printed plurality of electrically conductive traces, the plurality of light sources mounted on the planar surface, and the polymer sheet is applied. The plurality of light sources are embedded into the composite base and are also flush with a top surface of the stack-up, and the substrate is also embedded into the composite base underneath the plurality of light sources at the mounting positions.

Example lighting panels described integrate light sources into crush core panels to create a lighting effect that may be used for interior panels of aircraft, for example. Example methods for manufacturing described herein may use a plastic film with printed traces and bonded light sources that are then integrated into a panel via a method of crush core processing with composites. A decorative layer can then be applied over the light sources. This process can be used to integrate a lighting feature similar to Starry Skies into any crush core aircraft panels (e.g., ceilings, stow bins, valences, sidewalls, etc.).

Thus, in some examples, the disclosure relates to "Starry Sky" aircraft ceiling panel lighting systems and methods for manufacturing them. The lighting panels comprise a plurality of small light sources, such as micro-miniature light emitting diodes (LEDs), or alternatively, organic light emitting diodes (OLEDs), and together with control circuitry connected with conductive traces that are printed or otherwise formed onto an aircraft structural ceiling panel and/or to a lamination of flexible substrates that are then bonded to such a structural ceiling panel in the form of an appliqué therefor. The result is a Starry Sky lighting panel construction that is lighter, smaller, less expensive, and easier to retrofit to existing aircraft than existing Starry Sky lighting panel systems.

In other examples, a composite panel and method of manufacturing a composite panel is described. An example composite panel includes a plurality of plies assembled in a stack-up, and a trace sheet with electrically conductive traces and a plurality of transducer discs positioned onto the electrically conductive traces at positions such that the electrically conductive traces form an electrical interconnection between selected ones of the electrically conductive traces and associated ones of the transducer discs. The trace sheet is included as an internal ply in the stack-up of the plurality of plies. The composite panel also includes a composite base upon which the stack-up of the plurality of plies is applied, and the plurality of plies are cured upon the composite base to integrate the trace sheet and the plurality of transducer discs into the composite base. In examples described below, the transducer discs may be microphone discs or loud-speaker discs. In further examples, the composite panel may also include light sources, like the lighting panel above, in combination with microphone discs and/or loud-speaker discs. Any combination of microphone discs, loud-speaker discs, and light sources may be included in the composite panel.

Referring now to FIGS. 1-6, an example process is shown for manufacturing a lighting panel, according to an example embodiment. In FIG. 1, a substrate 200 is shown that has a planar surface 202. The planar surface 202 provides a relatively smooth surface or substantially flat surface.

As used herein, by the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide. Similarly, the term "about" includes aspects of the recited characteristic, parameter, or value allowing for deviations or variations, including for example, tolerances, measurement error, measurement accuracy limitations and other factors known to skill in the art, and also ranges of the parameters extending a reasonable amount to provide for such variations.

The substrate 200 may comprise a polymer film, or a polyvinyl fluoride (PVF) material, such as Tedlar film (Du Pont Tedlar polyvinyl fluoride (PVF)), for example. Other flexible, dielectric substrate materials may also be used for the substrate 200, such as, for example, Kapton, Mylar or polyvinyl chloride (PVC) materials.

Figure 7:
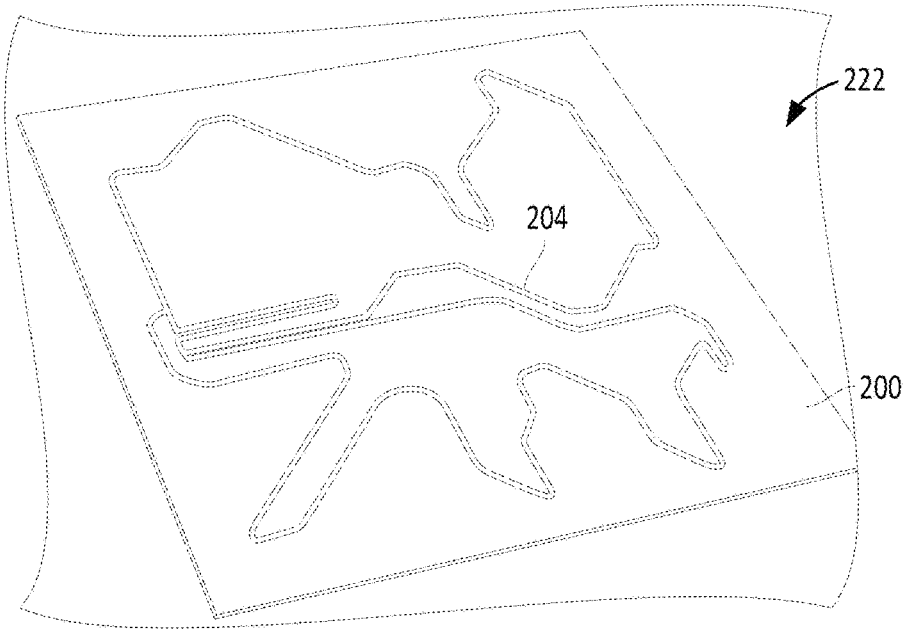
FIG. 7 illustrates a top view of the substrate with electrically conductive traces, according to an example embodiment.

A plurality of electrically conductive traces 204 are printed onto the planar surface 202 of the substrate 200. Electrically conductive traces 204 are shown in FIG. 7. The electrically conductive traces 204 can be written on the planar surface 202 of the substrate 200 so as to make electrical connections with respective leads of electrical components (i.e., anode and cathode of LEDs).

One or more of several conductive trace writing methods may be used to print the electrically conductive traces 204 on the substrate 200. In one example, plasma spraying may be used to deposit a wide range of conductive or non-conductive materials directly onto conformal surfaces. In another example, aerosol spraying can also be used to deposit a wide range of materials with extremely fine (e.g., 4-5 micron) feature size, either on flat substrates or on conformal surfaces. In still another example, ink jet printing technology can also be used to print to flat substrates, which may then be adhered to conformal surfaces. And finally, as another example, screen printing of conductive inks may be used to print to polymer film which is then adhered to a conformal surface. Any combination of such techniques may also be used. Printed electronics allows the use of flexible substrates, which lowers production costs and allows fabrication of mechanically flexible circuits.

Figure 2:
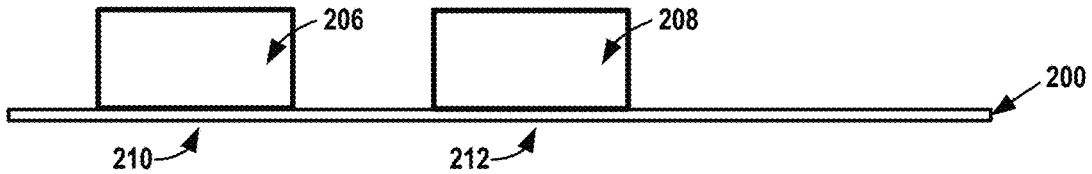
FIG. 2 illustrates another portion of the example process for manufacturing a lighting panel, in which a plurality of light sources are mounted onto the plurality of electrically conductive traces on the planar surface of the substrate at mounting positions, according to an example embodiment.
Figure 8:
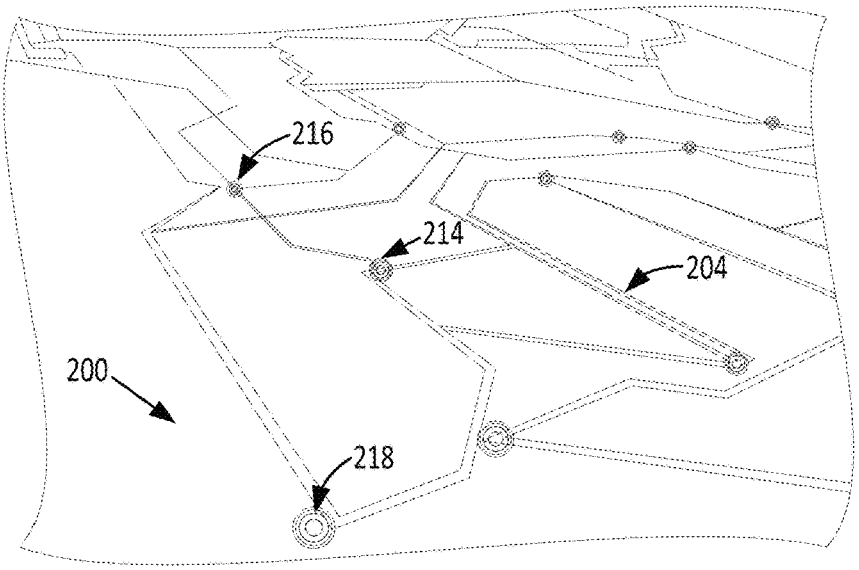
FIG. 8 illustrates the substrate with a circuit including light sources, according to an example embodiment.

As shown in FIG. 2, a plurality of light sources 206 and 208 are mounted onto the plurality of electrically conductive traces 204 on the planar surface 202 of the substrate 200 at mounting positions 210 and 212 such that the plurality of electrically conductive traces 204 form an electrical interconnection between selected ones of the plurality of electrically conductive traces and associated ones of the plurality of light sources. The electrically conductive traces 204 may comprise groups of circuits, and the light sources 206 and 208 are mounted onto the electrically conductive traces 204 so as to form the groups of circuits. As an example, FIG. 8 illustrates the substrate with a circuit including light sources 214, 216, and 218. Multiple circuits may be included based on interconnection of various light sources.

The electrically conductive traces interconnect the light sources 206 and 208 with power and control circuitry such that each light source 206 and 208 can be controlled independently of the other, and can be caused to blink or "twinkle." Alternatively, groups of associated light source in the panel can be controlled independently of each other.

The light sources 206 and 208 may include light emitting diodes (LEDs), organic light emitting diodes (OLEDs), other surface mounted devices (SMDs), or a combination of each. The light sources 206 and 208 may be mounted using a conductive adhesive, and the resulting substrate-light source assembly may be cured, e.g., by UV radiation, if UV curing adhesives are used, or alternatively, may be cured with heat, for example, in an autoclave process.

Figure 3:
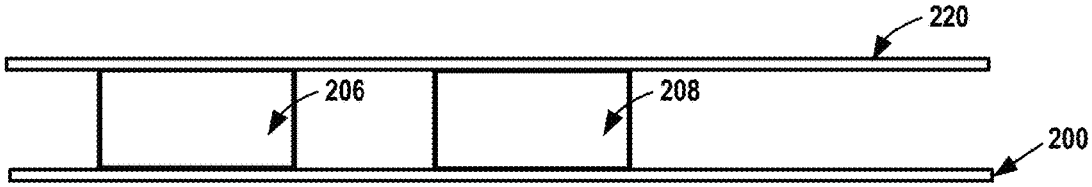
FIG. 3 illustrates another portion of the example process for manufacturing a lighting panel, in which a polymer sheet is provided over the light sources, according to an example embodiment.

As shown in FIG. 3, a polymer sheet 220 is provided over the light sources 206 and 208. The polymer sheet 220 can be a clear polymer sheet, and laid over the light sources 206 and 208 for attachment through a final process (described below).

Figure 4:
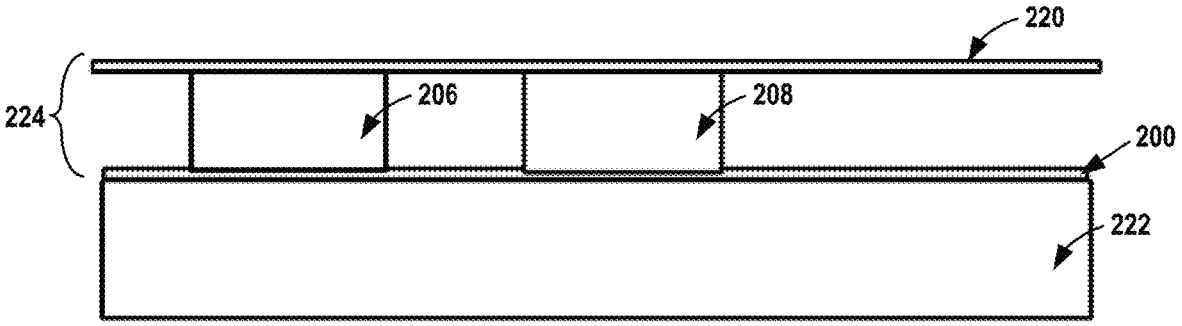
FIG. 4 illustrates another portion of the example process for manufacturing a lighting panel, in which a composite base is provided upon which a stack-up of the substrate with the printed plurality of electrically conductive traces, the light sources mounted on the planar surface, and the polymer sheet is applied, according to an example embodiment.

As shown in FIG. 4, a composite base 222 is provided upon which a stack-up 224 of the substrate 200 with the printed plurality of electrically conductive traces 204, the light sources 206 and 208 mounted on the planar surface 202, and the polymer sheet 220 is applied. The composite base 222 may comprise an existing aircraft structural ceiling panel, made of, e.g., a polycarbonate or polyurethane plastic. As another example, the composite base 222 may comprise a honeycomb core panel. The composite base 222 may include any composite material, such as a lightweight material like an uncured pre-impregnated reinforcing tape or fabric (i.e., "prepreg"). The tape or fabric can include a plurality of fibers such as graphite fibers that are embedded within a matrix material, such as a polymer, e.g., an epoxy or phenolic. The tape or fabric could be unidirectional or woven depending on a degree of reinforcement desired.

Figure 5:
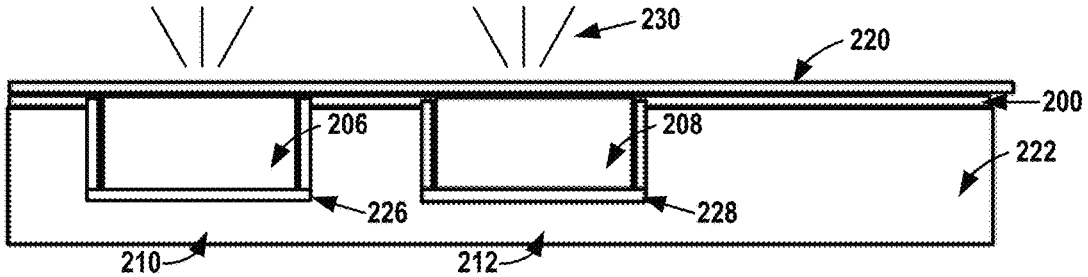
FIG. 5 illustrates another portion of the example process for manufacturing a lighting panel, in which the light sources are embedded into the composite base and are also flush with a top surface of the stack-up, and the substrate is also embedded into the composite base underneath the light sources at the mounting positions, according to an example embodiment.

As shown in FIG. 5, using a crush-core process, the light sources 206 and 208 are embedded into the composite base 222 and are also flush with a top surface of the stack-up 224, and the substrate 200 is also embedded into the composite base 222 underneath the light sources 206 and 208 at the mounting positions 210 and 212. For example, portions 226 and 228 of the substrate 200 are embedded into the composite base 222 underneath the light sources 206 and 208 at the mounting positions 210 and 212.

The crush core process includes placing the composite base 222 with the stack-up 224 in a large press, and the stack-up 224 is crushed down into the composite base 222 to a predetermined thickness. Example pressures up to 300 psi/20.7 bar cause honeycomb cell walls of the composite base 222 to fold over and flatten, creating more bonding surface area for the stack-up 224. This method creates panels of consistent thickness, ensuring good fit and finish during installation. Thus, using the crush core process, the stack-up 224 is bonded into the composite base 222 using pressure and heat to cure the bond.

As shown in FIG. 5, the polymer sheet 220 covers the light sources 206 and 208. The light sources 206 and 208 are in contact with the polymer sheet 220 and are operated to shine light 230 through the polymer sheet 220. No holes are provided in the polymer sheet 220 that expose the light sources 206 and 208. In addition, no pockets or potting of the composite base 222 are required for insertion of the light sources 206 and 208. Rather, the crush core process embeds the light sources 206 and 208 into the composite base 222 with corresponding portions 226 and 228 of the substrate 200 embedded underneath the light sources 206 and 208 to provide electrical connections. Without the need for pre-drilled holes or pre-formed pockets, additional manufacturing steps can be removed. The ability to integrate the light sources 206 and 208 into the composite base 222 without requiring a pocket or potting of the light sources 206 and 208, or other apertures or lenses enables the panel to be manufactured more efficiently.

Figure 6:
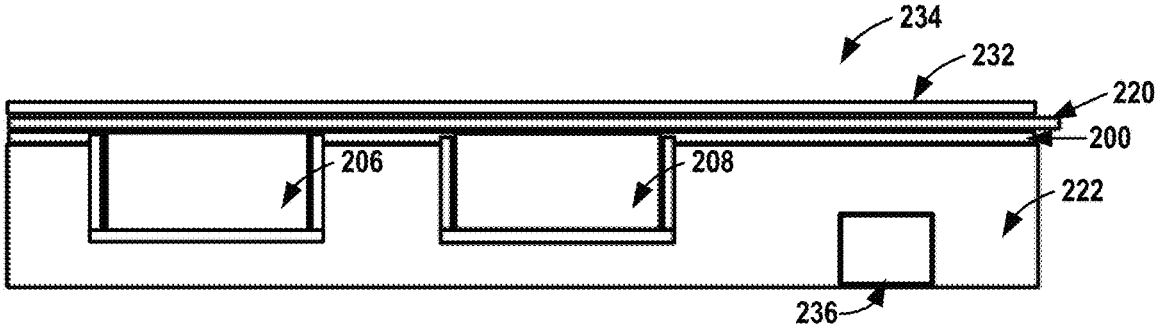
FIG. 6 illustrates another portion of the example process for manufacturing a lighting panel, in which a decorative film can also be applied over the polymer sheet to cover the light sources, according to an example embodiment.

As shown in FIG. 6, a decorative film can also be applied over the polymer sheet 220 to cover the light sources 206 and 208. In this example, the decorative film 232 may be a clear or decorative laminate ("declams") comprising a thin, flexible film, such as Du Pont Tedlar polyvinyl fluoride (PVF). The decorative film 232 also does not require any small apertures, or vias through which the light sources 206 and 208 are respectively exposed. The decorative film 232 can be bonded to the polymer sheet 220 using an adhesive. FIG. 6 illustrates a completed lighting panel 234. In other examples, the decorative film 232 may be replaced with a layer painted on for decoration.

Figure 9:
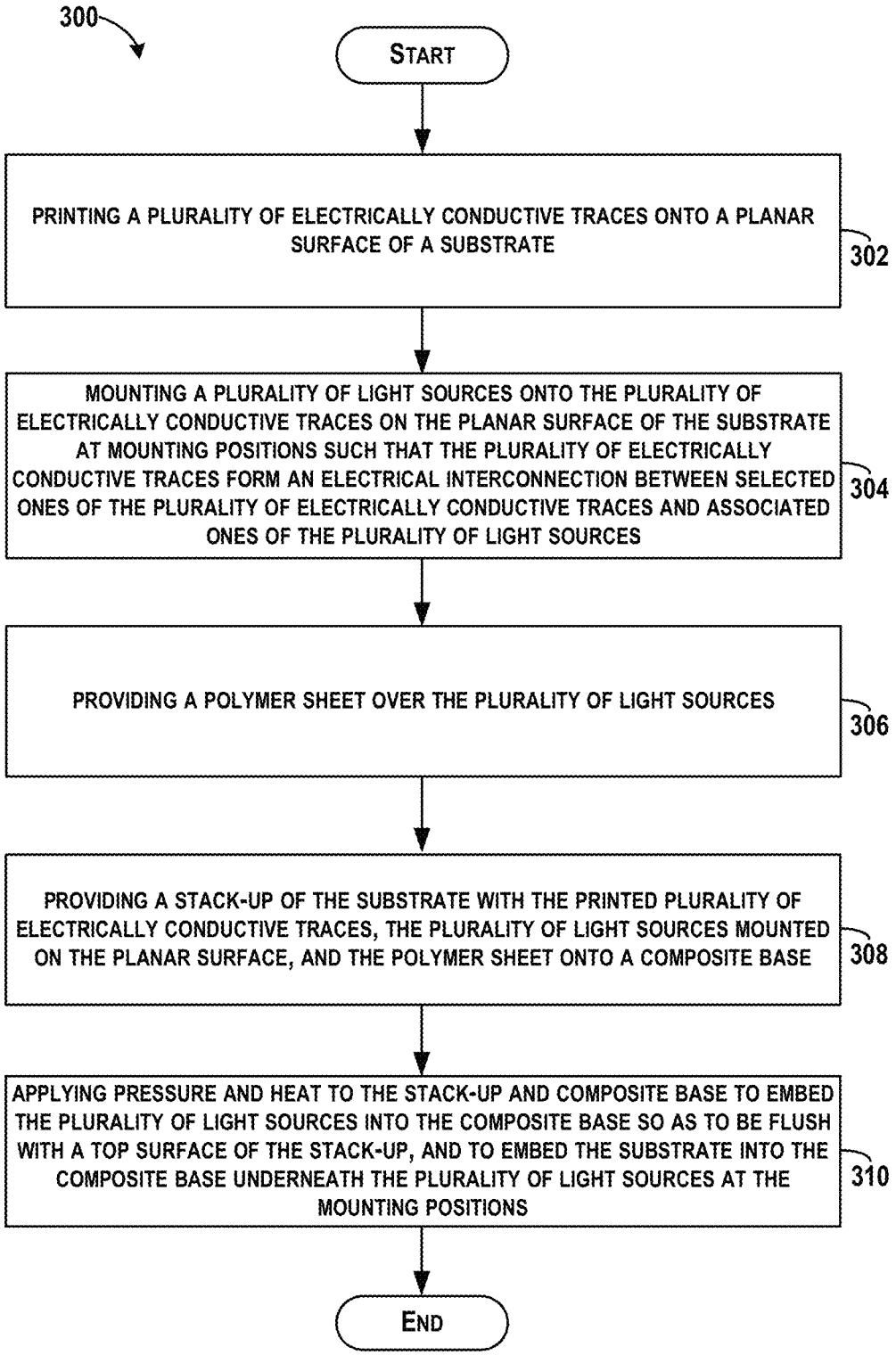
FIG. 9 shows a flowchart of an example method for manufacturing a lighting panel, according to an example embodiment.

FIG. 9 shows a flowchart of an example method 300 for manufacturing a lighting panel, according to an example embodiment. Method 300 shown in FIG. 9 presents an embodiment of a method that, for example, could be used within the processes shown in FIGS. 1-6, for example. Method 300 may include one or more operations, functions, or actions as illustrated by one or more of blocks 302-310. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

It should be understood that for this and other processes and methods disclosed herein, flowcharts show functionality and operation of one possible implementation of present embodiments. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

At block 302, the method 300 includes printing the plurality of electrically conductive traces 204 onto the planar surface 202 of the substrate 200. As an example, the electrically conductive traces 204 may be screen printed as silver ink on a Tedlar substrate or other polyvinyl fluoride (PVF) material. The electrically conductive traces 204 may be printed to provide connections to electrical components (or to terminals of electrical components), so that the electrical components can be placed randomly across the substrate 200.

At block 304, the method 300 includes mounting the plurality of light sources 206 and 208 onto the plurality of electrically conductive traces 204 on the planar surface 202 of the substrate 200 at mounting positions 210 and 212 such that the plurality of electrically conductive traces 204 form an electrical interconnection between selected ones of the plurality of electrically conductive traces and associated ones of the plurality of light sources. The light sources 206 and 208 may be mounted using a conductive epoxy. The electrically conductive traces 204 may be printed to result in groups of circuits, and the light sources 206 and 208 are mounted onto the electrically conductive traces 204 so as to form the groups of circuits. The electrically conductive traces 204 may be printed so as to result in four groups of circuits that are independent and not wired in parallel, for example.

At block 306, the method 300 includes providing the polymer sheet 220 over the plurality of light sources 206 and 208. The polymer sheet 220 protects the electrically conductive traces 204 and the light sources 206 and 208 from sweep/sand and paint processes applied to a final product of the lighting panel. The polymer sheet 220 can be a clear polymer sheet, and covers the light sources 206 and 208 so that the light sources 206 and 208 are in contact with the polymer sheet 220 and shine light through the polymer sheet 220.

At block 308, the method 300 includes providing the stack-up 224 of the substrate 200 with the printed plurality of electrically conductive traces 204, the plurality of light sources 206 and 208 mounted on the planar surface 202, and the polymer sheet 220 onto the composite base 222. The composite base 222 may include a honeycomb core panel.

At block 310, the method 300 includes applying pressure and heat to the stack-up 224 and the composite base 222 to embed the plurality of light sources 206 and 208 into the composite base 222 so as to be flush with a top surface of the stack-up 224, and to embed the substrate 200 into the composite base 222 underneath the plurality of light sources 206 and 208 at the mounting positions 210 and 212. Pressure and heat may be applied using a crush core process. When the materials are removed from the press, the light sources 206 and 208 are flush with the top surface and embedded into the composite base 222.

The ability to integrate the light sources 206 and 208 into the composite base 222 without requiring pockets or pre-drilled holes formed for the light sources 206 and 208, and no need for potting of the light sources 206 and 208 allows for integration of the substrate 200 and light sources 206 and 208 into the composite base 222 in a manner to reduce weight, size, and cost of prior systems. Further, with no pockets created, then additional encapsulation with a potting material is also avoided. The light sources 206 and 208 can be crushed directly into the composite base 222 which allows for integration without use of a pocket and potting material and has been shown to provide a better surface finish.

In addition, the light sources 206 and 208 are bright enough to not need a hole to be cut in any top layer or coating which further simplifies the design. Thus, there is no need for holes or lenses or other structures to project light through the polymer sheet 220 since the light sources 206 and 208 directly contact the polymer sheet 220.

A decorative film 232, or paint, may then be applied to a top surface of the polymer sheet 220, which enables painting by protecting the electronics. Connectors can then be installed for power and operation of the lighting panel.

As those of skill in the art will also appreciate, there are numerous other fabrication and assembly options available that will arrive at the same or a substantially similar lighting panel 234 configuration.

The lighting panel 234 may include a power and control module insert 236 for supplying electrical power and control signals to the light sources 206 and 208 of the lighting panel 234. This enables the printed electrically conductive traces 204 to be connected to wiring. Still further, other discrete electrical components, e.g., microprocessors and RF control or transceiver components to power and control the light sources 206 and 208, can be embedded into the power and control module insert 236. The power and control module insert 236 may further incorporate terminal input/output connection pads that enable easy electrical interconnection between the power and control module insert 236 and the light sources 206 and 208 via the electrically conductive traces 204.

As those of skill in the art will appreciate, many aircraft systems can provide electrical power and control signals to light fixtures or the lighting panel 234. Electronics located within the light panel 234, such as within the power and control module insert 236, can control color and brightness of emitted light. Pulse width modulation can be used to control brightness of each of the light sources 206 and 208 within the lighting panel 234. Furthermore, an aircraft ceiling may include many lighting panels, and each lighting panel may be individually controlled.

Control over the lighting panel 234 (typically involving overall star field brightness and blink rate) may be effected, for example, by transmitting control commands or settings from the aircraft to the lighting panel 234 via a wireless link and received at the power and control module insert 236. In one example, the power and control module insert 236 includes a radio receiver that receives such commands or settings. An antenna for the radio may be printed directly on the substrate 200 or on a substrate laminated thereto, along with other electrical conductors and components.

In another example, control of the lighting panel 234 may be effected by transmitting control commands or settings from the airplane to the panel via communication over power line (COPL) technology. Electronics of the aircraft superimpose control/setting signals over a power signal to the lighting panel 234. A COPL transceiver located in the power and control module insert 236 interprets these signals and controls the light sources 206 and 208 accordingly.

The lighting panel 234 offers a number of advantages over prior lighting panels. Components of the lighting panel 234 are less expensive (excluding investment in capital equipment). The current manufacturing process has high ergonomic cost factors, including fine detail, repetitive motions and the like which are substantially eliminated in the examples disclosed herein.

Additionally, integration of direct write electronics and the electrically conductive traces 204 into the lighting panel 234 has several additional benefits, including reduced panel weight, shorter process flow times, improved durability, a more efficient form factor and improved ergonomics of manufacture. In the past, some aircraft customers have not selected the Starry Sky lighting option because of the weight penalty associated therewith. The lighting panel 234 can provide a weight savings per panel, which, in an aircraft equipped with numerous such panels, results in an appreciable weight savings over prior panels.

Further, as described above, in some examples the lighting panel 234 may have a wired supply of electrical power and a wireless, e.g., radio, interface for communication and control. Thus, the lighting panel 234 requires a low voltage electrical interface for power, and power can be tapped from existing sources, such as ceiling wash lights that are typically turned down to low power while the starry sky effect is operating. Tapping power from local sources and providing wireless control simplifies retrofit of existing aircraft by reducing the need to run additional aircraft wiring.

While various examples of the lighting panel disclosed herein are described and illustrated in the context of aircraft interior ceiling lighting systems, it will be evident that they are not limited to this particular application, but may be used in a variety of other applications, e.g., other aircraft surfaces, such as entry area ceilings, destination spaces, or even in non-aerospace applications, such as dance halls theaters residential ceilings, advertisements, and the like.

Figure 10:
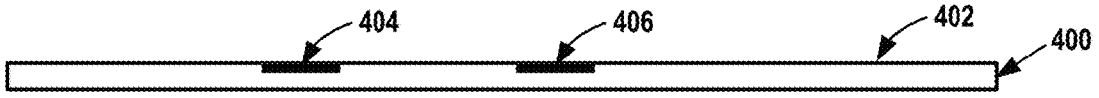
FIG. 10 illustrates a portion of an example process for manufacturing a composite panel, in which a trace sheet is shown that has a planar surface, according to an example embodiment.

Referring now to FIGS. 10-14, an example process is shown for manufacturing a composite panel, according to an example embodiment. In FIG. 10, a trace sheet 400 is shown again that has a planar surface 402. The planar surface 402 provides a relatively smooth surface or substantially flat surface. The plurality of electrically conductive traces 204 are printed onto the planar surface 402 of the substrate 400 as described above and shown in FIG. 7. The electrically conductive traces 204 can be written on the planar surface 402 of the trace sheet 400 so as to make electrical connections with respective leads of electrical components.

The trace sheet 400 may comprise a substrate, similar to the substrate 200 described above.

Following, a plurality of transducer discs 404 and 406 are positioned onto the electrically conductive traces 204 at positions such that the electrically conductive traces 204 form an electrical interconnection between selected ones of the electrically conductive traces and associated ones of the transducer discs. The electrically conductive traces 204 may comprise groups of circuits, and the transducer discs 404 and 406 are mounted onto the electrically conductive traces 204 so as to form the groups of circuits. Thus, the trace sheet 400 includes the electrically conductive traces 204 and the plurality of transducer discs 404 and 406 printed thereon.

In one example, the transducer discs 404 and 406 include piezo-electric microphone components printed on the trace sheet 400. For instance, the transducer discs 404 and 406 may include acoustic-to-electric transducers that convert sound into an electrical signal as a microphone. In another example, the transducer discs 404 and 406 include electroacoustic transducers that convert an electrical audio signal into a corresponding sound as a loud-speaker. And, in yet another example, the trace sheet 400 includes many transducer discs, and some of the transducer discs are acoustic-to-electric transducer discs as microphones and some of the transducer discs are electroacoustic transducers as loud-speakers.

The electrically conductive traces 204 interconnect the transducer discs 404 and 406 with power and control circuitry such that each transducer disc 404 and 406 can be controlled independently of the other. Alternatively, groups of associated transducer discs 404 and 406 can be controlled together.

Figure 11:
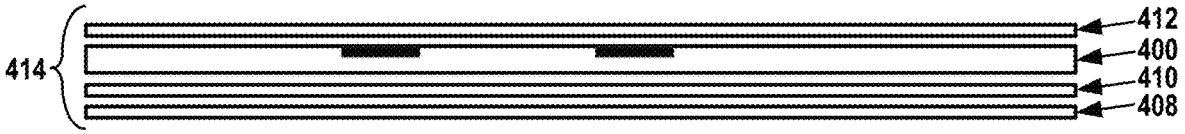
FIG. 11 illustrates another portion of an example process for manufacturing a composite panel, in which a plurality of plies are assembled in a stack-up, according to an example embodiment.

As shown in FIG. 11, a plurality of plies 400, 408, 410, and 412 are assembled in a stack-up 414. The trace sheet 400 is included as an internal ply in the stack-up 414 of the plurality of plies. Other plies in the stack-up 414 can include a first glass layer 408, a second glass layer 410, and a polymer sheet 412. The polymer sheet 412 may be a clear cap Tedlar layer.

Figure 12:
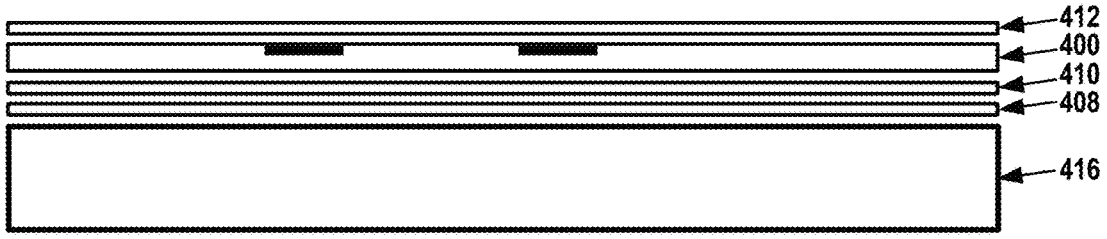
FIG. 12 illustrates another portion of an example process for manufacturing a composite panel, in which the stack-up of the plurality of plies is applied to a composite base, according to an example embodiment.
Figure 13:
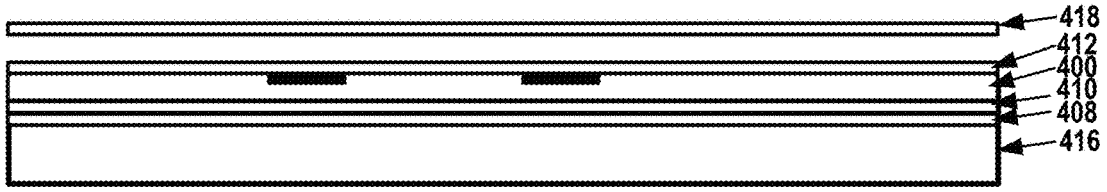
FIG. 13 illustrates another portion of an example process for manufacturing a composite panel, in which the trace sheet and the plurality of transducer discs are integrated into the composite base, according to an example embodiment.

As shown in FIG. 12, the stack-up 414 of the plurality of plies 400, 408, 410, and 412 is applied to a composite base 416. The stack-up 414 of the plurality of plies 400, 408, 410, and 412 is then cured upon the composite base 416 to integrate the trace sheet 400 and the plurality of transducer discs 404 and 406 into the composite base 416. FIG. 13 illustrates the trace sheet 400 and the plurality of transducer discs 404 and 406 integrated into the composite base 416.

The composite base 416 includes a honeycomb core panel, such as Nomex honeycomb core (made from aramid fiber paper supplied by DuPont Advanced Fibers Systems, Richmond, Va.). The composite base 416 may include any composite material, such as a lightweight material like an uncured pre-impregnated reinforcing tape or fabric (i.e., "prepreg"). The tape or fabric can include a plurality of fibers such as graphite fibers that are embedded within a matrix material, such as a polymer, e.g., an epoxy or phenolic. The tape or fabric could be unidirectional or woven depending on a degree of reinforcement desired.

Figure 14:
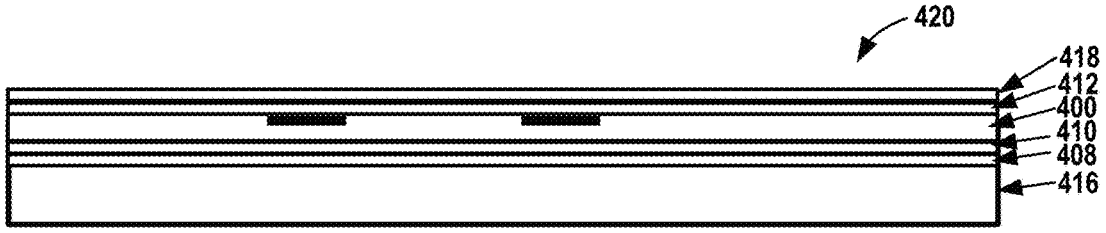
FIG. 14 illustrates an example completed composite panel.

The stack-up 414 may be cured upon the composite base 416 using a crush-core process as described above. As shown in the example configuration at FIG. 13, the composite base 416 can be faced with two skin plies of glass 408 and 410 for added strength. The polymer sheet 412 may be a final layer, and the trace sheet 400 is provided in the stack-up 414 between the polymer sheet 412 and the composite base 416. In other examples, as shown in FIG. 13, a paint or decorative film 418 can also be applied over the polymer sheet 412. In this example, the decorative film 418 may be a clear or decorative laminate ("declams") comprising a thin, flexible film, such as Du Pont Tedlar polyvinyl fluoride (PVF). The decorative film 418 can be bonded to the polymer sheet 412 using an adhesive. FIG. 14 illustrates one example completed composite panel 420.

Figure 15:
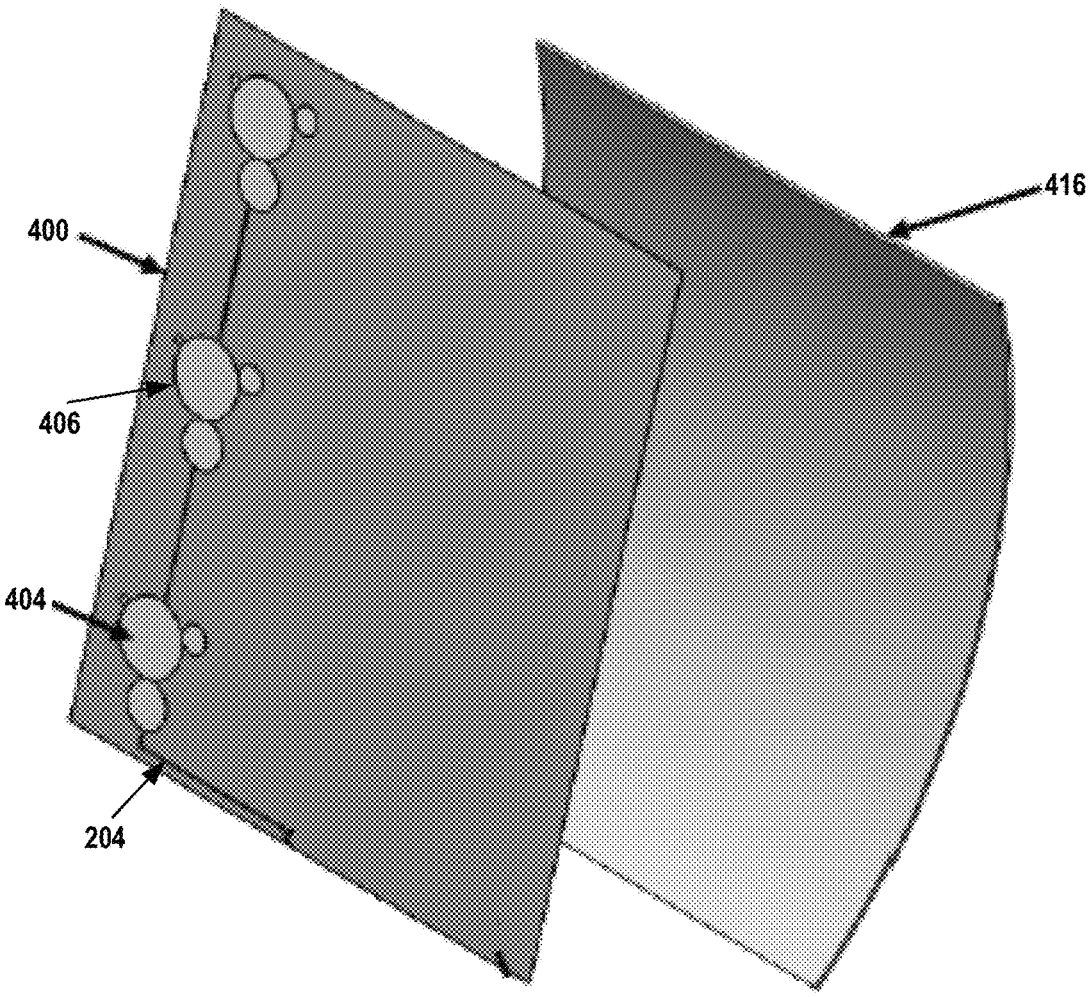
FIG. 15 illustrates a side view of one example of the trace sheet, according to an example embodiment.

FIG. 15 illustrates a side view of the trace sheet 400, according to an example embodiment. A configuration of the electrically conductive traces 204 and the transducer discs 404 and 406 is shown as one example. In FIG. 15, other plies of the stack-up 414 are not shown.

Figure 16:
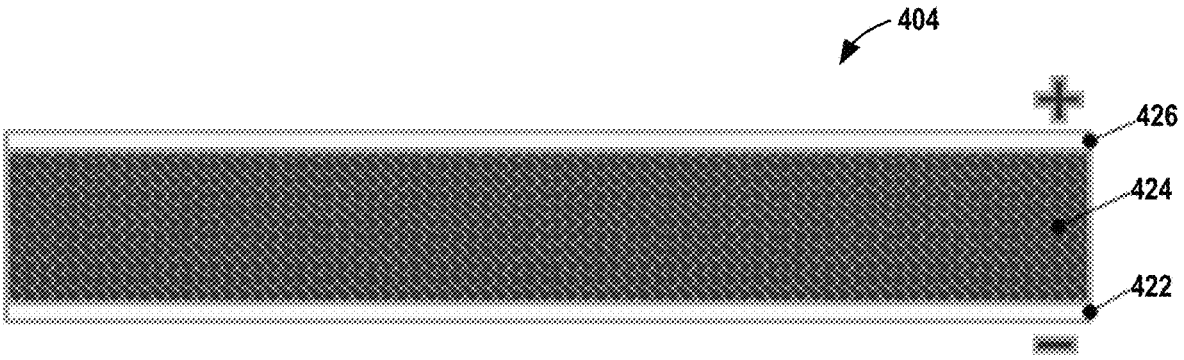
FIG. 16 illustrates a detailed side view of one of the transducer discs, such as the transducer disc, according to an example embodiment.

FIG. 16 illustrates a detailed side view of one of the transducer discs, such as the transducer disc 404. Initially, a bottom conductive trace 422 is printed onto the trace sheet 400, and then a piezo-electric material 424 is printed onto the bottom conductive trace 422, and then a top conductive trace 426 is printed onto the piezo-electric material 424. Example piezo electric materials include PZT (Lead Zirconium Titanate), $BaTiO_3$ (Barium Titanate), and PVDF (Polyvinylidene Flouride).

Using printed electronics technology, the transducer discs 404 and 406 can be printed onto the trace sheet 400 along with the electrically conductive traces 204. When formed as microphones, the transducer discs 404 and 406 compress due to received sounds waves causing a change in voltage. Strains from pressure changes that originate from acoustic waves can be measured. Voltage changes are then converted back to digital sound.

A diameter of the transducer discs 404 and 406 can be optimized for a specific sound frequency range.

The transducer discs 404 and 406 can be used as input devices as microphones or output devices as speakers, and the difference in use is based on a size of the transducer discs 404 and 406. A larger size generally will have a larger impedance/resistance value and can be used as a loud-speaker. A smaller size generally will have a smaller impedance/resistance value and can be used as a microphone. Thus, some of the transducer discs 404 and 406, and many others that can be included on the trace sheet 400 as well can be configured as microphones, and some of the transducer discs can be configured as speakers to enable a two-way communication device. Thus, the trace sheet 400 may include any number of microphone discs and loud-speaker discs in any combination.

Figure 17:
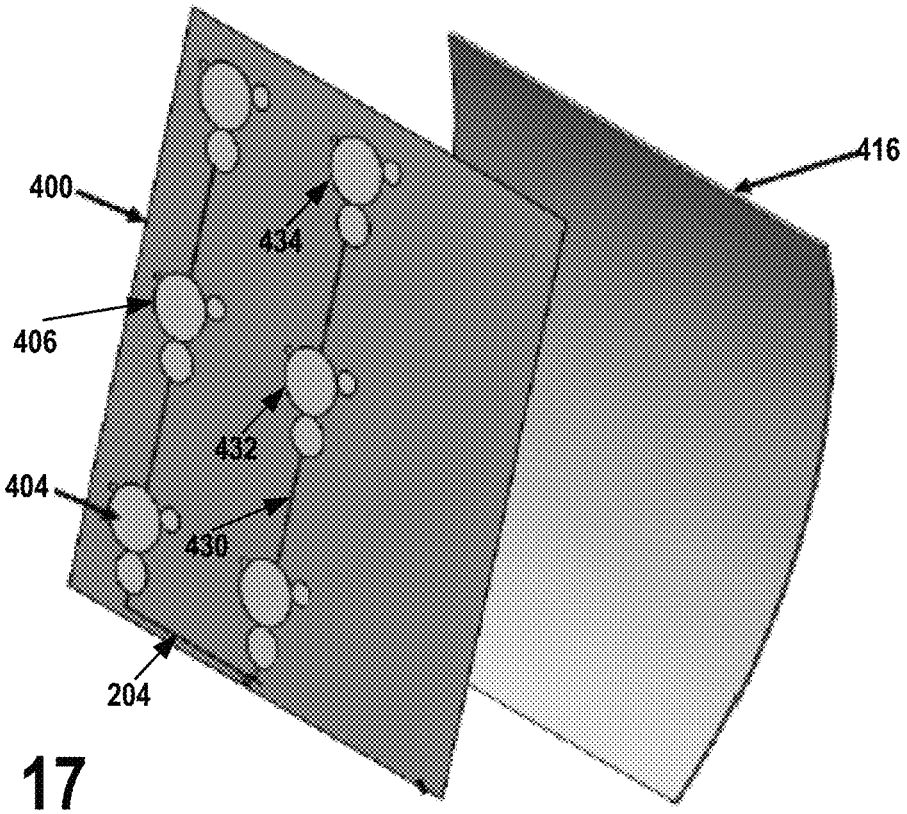
FIG. 17 illustrates a side view of another example of the trace sheet, according to an example embodiment.

FIG. 17 illustrates a side view of another example of the trace sheet 400. In this example, the transducer discs 404 and 406 may be configured as microphones. Then, a second plurality of electrically conductive traces 430 are included on the trace sheet 400, and a plurality of loud-speaker transducers 432 and 434 positioned onto the second plurality of electrically conductive traces 430 at positions such that the second plurality of electrically conductive traces 430 form an electrical interconnection between selected ones of the second plurality of electrically conductive traces and associated ones of the plurality of loud-speaker transducers. In this example, the loud-speaker transducers 432 and 434 include electroacoustic transducers that convert an electrical audio signal into a corresponding sound as a loud-speaker.

Further, in this example, the trace sheet 400 includes both microphone transducer discs 404 and 406, as well as loud-speaker transducers 432 and 434 to enable two-way communication. The electrically conductive traces 204 and the electrically conductive traces 430 may comprise independent circuits enabling independent operation of the microphone transducer discs 404 and 406 and the loud-speaker transducers 432 and 434.

Figure 18:
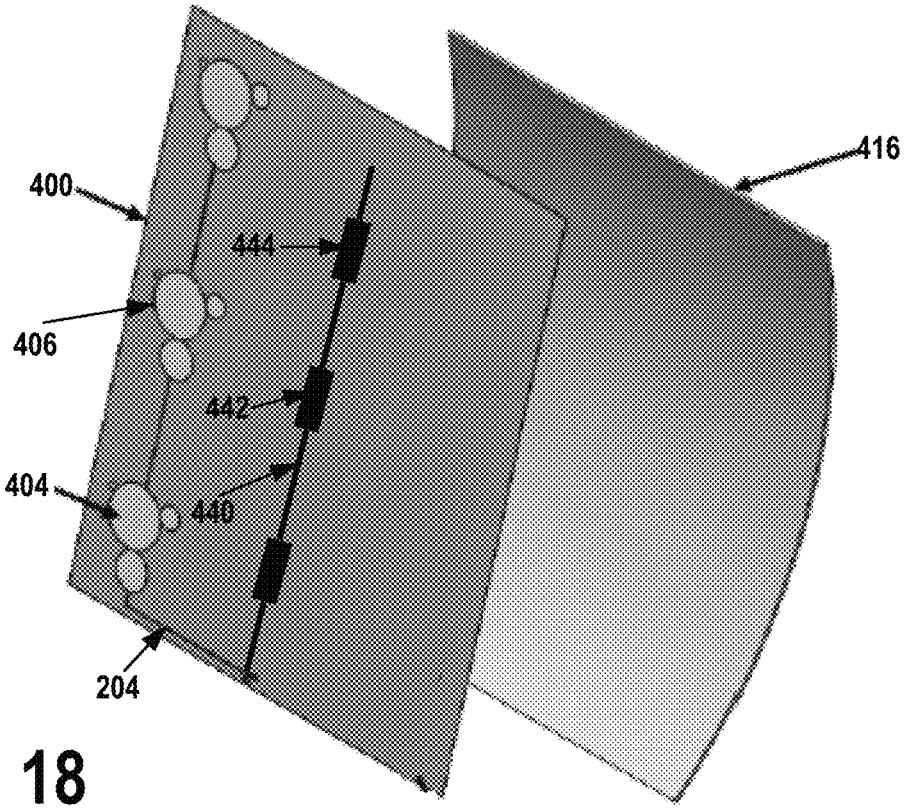
FIG. 18 illustrates a side view of yet another example of the trace sheet, according to an example embodiment.

FIG. 18 illustrates a side view of another example of the trace sheet 400. In this example, the transducer discs 404 and 406 may be configured as microphones or as loud-speakers, or as a combination of microphones and loud-speakers. Then, a second plurality of electrically conductive traces 440 can be included on the trace sheet 400 and a plurality of light sources 442 and 444 can be mounted onto the second plurality of electrically conductive traces 440 at light mounting positions such that the second plurality of electrically conductive traces form an electrical interconnection between selected ones of the second plurality of electrically conductive traces and associated ones of the plurality of light sources. As described above with reference to FIGS. 6-8, the plurality of light sources 442 and 444 are embedded into the composite base 416. The electrically conductive traces 204 and the electrically conductive traces 440 may comprise independent circuits enabling independent operation of the transducer discs 404 and 406 and the light sources 442 and 444.

Figure 19:
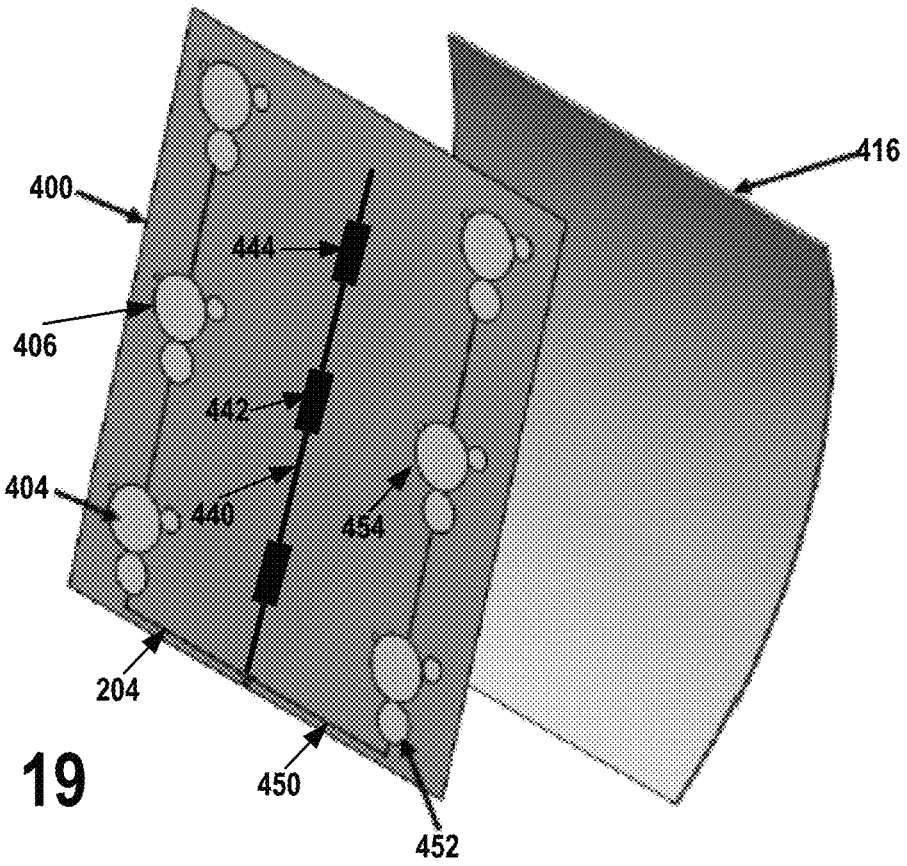
FIG. 19 illustrates a side view of yet another example of the trace sheet, according to an example embodiment.

FIG. 19 illustrates a side view of another example of the trace sheet 400. In this example, the transducer discs 404 and 406 may be configured as microphones, and the plurality of light sources 442 and 444 can be mounted onto the trace sheet 400 as well. Then, a third plurality of electrically conductive traces 450 may be included and a plurality of loud-speaker transducers 452 and 454 are positioned onto the third plurality of electrically conductive traces 450 at positions such that the third plurality of electrically conductive traces form an electrical interconnection between selected ones of the third plurality of electrically conductive traces and associated ones of the plurality of loud-speaker transducers. The plurality of loud-speaker transducers 452 and 454 include electroacoustic transducers that convert an electrical audio signal into a corresponding sound as a loud-speaker. In this example, the trace sheet 400 includes microphones, loud-speakers, and light sources all embedded therein, and the electrically conductive traces 204, 440 and 450 may comprise independent circuits enabling independent operation of the transducer discs 404 and 406, the light sources 442 and 444, and the loud-speaker transducers 452 and 454. Although the transducer discs 404 and 406, the light sources 442 and 444, and the loud-speaker transducers 452 and 454 are shown arranged in separate rows, any configuration or layout of these components may be provided.

The composite panel thus may include any combination of microphone or loud-speaker transducer discs and light sources seamlessly integrated into the panel. The composite panel may comprise an aircraft wall, ceiling panel, or other aircraft interior structure such as stowbins, monuments, valences, etc. Further, the composite panel may be used in ceilings and sidewalls of aircraft or other vehicles (e.g., headliner of cars). Still further, the composite panel may be used for any architectural panel or structure such as a conference room wall or table or even smaller items such as cell phone cases or covers, for example. The composite panel is lightweight, inexpensive, and easy to manufacture and assemble.

Figure 20:
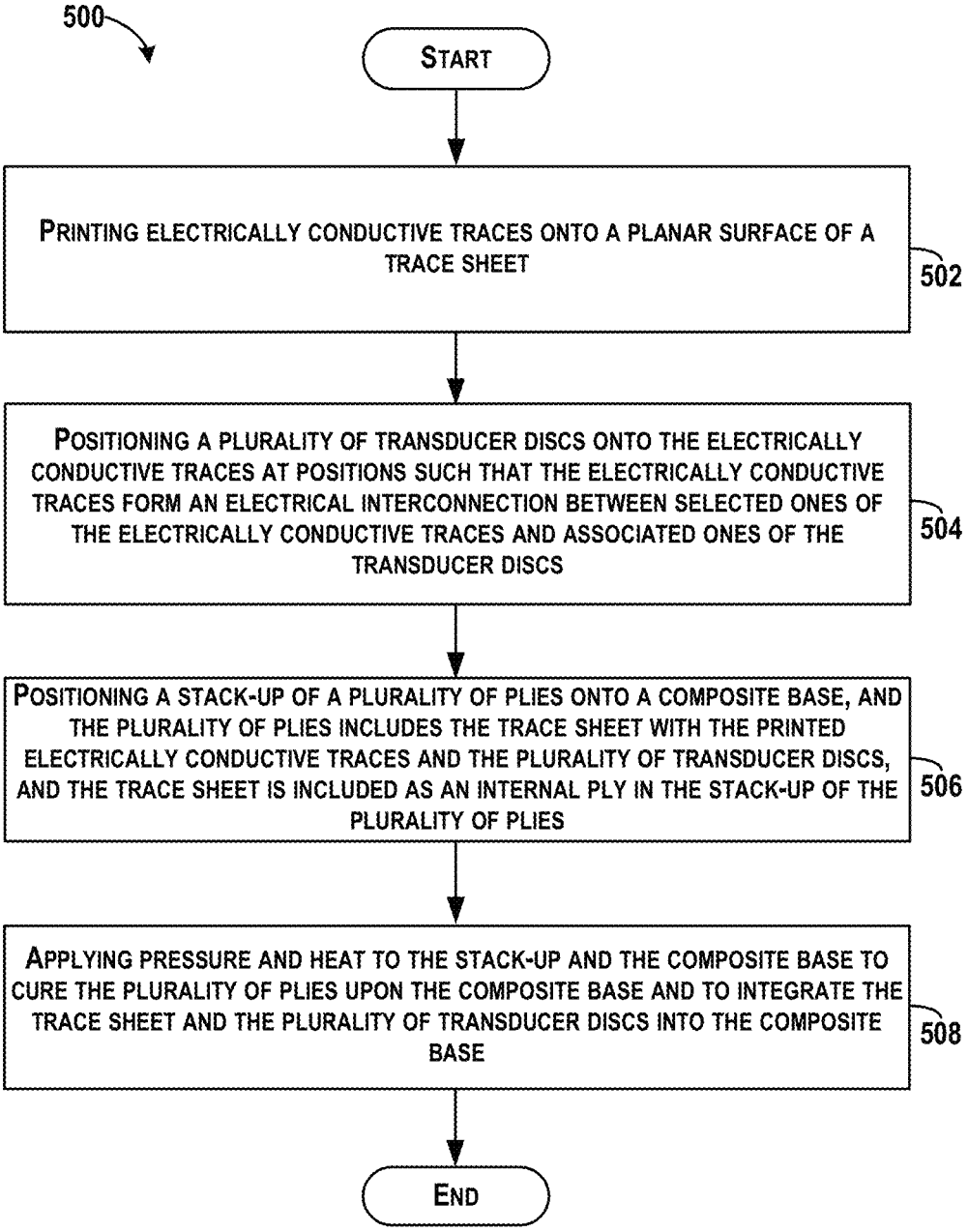
FIG. 20 shows a flowchart of an example method for manufacturing a composite panel, according to an example embodiment.

FIG. 20 shows a flowchart of an example method 500 for manufacturing a composite panel, according to an example embodiment. Method 500 shown in FIG. 20 presents an embodiment of a method that, for example, could be used within the processes shown in FIGS. 10-17, for example. Method 500 may include one or more operations, functions, or actions as illustrated by one or more of blocks 502-508. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

It should be understood that for this and other processes and methods disclosed herein, flowcharts show functionality and operation of one possible implementation of present embodiments. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

At block 502, the method 500 includes printing electrically conductive traces 204 onto a planar surface 402 of a trace sheet 400.

At block 504, the method 500 includes positioning a plurality of transducer discs 404 and 406 onto the electrically conductive traces 204 at positions such that the electrically conductive traces 204 form an electrical interconnection between selected ones of the electrically conductive traces and associated ones of the transducer discs. In one example, positioning the plurality of transducer discs 404 and 406 onto the electrically conductive traces 204 includes, for each of the plurality of transducer discs 404 and 406 printing a bottom conductive trace 422 onto the trace sheet 400, printing a piezo-electric material 424 onto the bottom conductive trace 422, and printing a top conductive trace 426 onto the piezo-electric material 424. In another example, the plurality of transducer discs 404 and 406 can be mounted to the trace sheet 400.

As described above, the plurality of transducer discs 404 and 406 can include acoustic-to-electric transducers that convert sound into an electrical signal as a microphone, electroacoustic transducers that convert an electrical audio signal into a corresponding sound as a loud-speaker, or a combination of microphone and loud-speaker transducers.

At block 506, the method 500 includes positioning a stack-up 414 of a plurality of plies 400, 408, 410, and 412 onto a composite base 416, and the plurality of plies 400, 408, 410, and 412 includes the trace sheet 400 with the printed electrically conductive traces 204 and the plurality of transducer discs 404 and 406, and the trace sheet 400 is included as an internal ply in the stack-up 414 of the plurality of plies. One of the plurality of plies includes a polymer sheet 412, and the trace sheet 400 is provided in the stack-up 414 between the polymer sheet 412 and the composite base 416.

At block 508, the method 500 includes applying pressure and heat to the stack-up 414 and the composite base 416 to cure the plurality of plies 400, 408, 410, and 412 upon the composite base 416 and to integrate the trace sheet 400 and the plurality of transducer discs 404 and 406 into the composite base 416.

Figure 21:
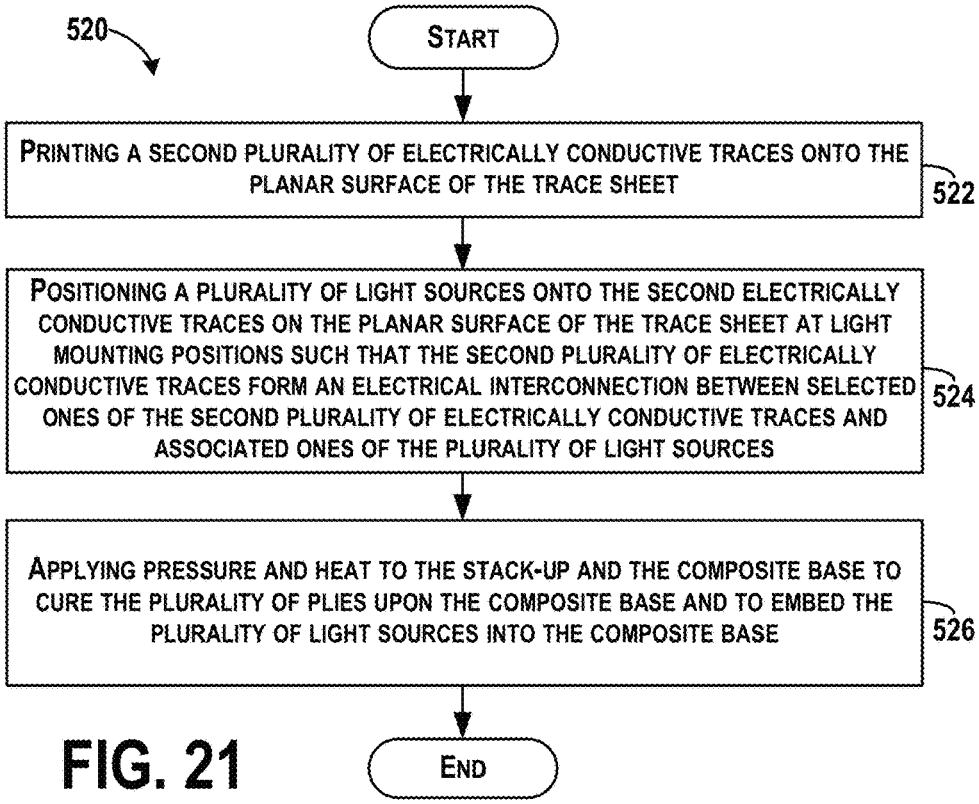
FIG. 21 shows a flowchart of another example method for manufacturing a composite panel, according to an example embodiment.

FIG. 21 shows a flowchart of another example method 520 for manufacturing a composite panel, according to an example embodiment. Method 520 shown in FIG. 21 presents an embodiment of a method that, for example, could be used within the processes shown in FIGS. 10-18, for example. Method 520 may include one or more operations, functions, or actions as illustrated by one or more of blocks 522-526. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

The method 520 may be performed in addition to the method 500 as described in FIG. 20.

At block 522, the method 520 includes printing a second plurality of electrically conductive traces 440 onto the planar surface of the trace sheet 400.

At block 524, the method 520 includes positioning a plurality of light sources 442 and 444 onto the second plurality of electrically conductive traces 440 on the planar surface of the trace sheet 400 at light mounting positions such that the second plurality of electrically conductive traces 440 form an electrical interconnection between selected ones of the second plurality of electrically conductive traces and associated ones of the plurality of light sources.

At block 526, the method 520 includes applying pressure and heat to the stack-up 414 and the composite base 416 to cure the plurality of plies 400, 408, 410, and 412 upon the composite base 416 and to embed the plurality of light sources 442 and 444 into the composite base 416.

Thus, using the method 520, the composite panel can be manufactured to include both light sources 442 and 444 and transducer discs 404 and 406, as shown in FIG. 18. The transducer discs 404 and 406 may be configured as microphones or loud-speakers for use in addition to the light sources 442 and 444. Thus, the composite panel may be manufactured with the light sources 442 and 444 and microphones, or with the light sources 442 and 444 and loud-speakers, or with all of the light sources 442 and 444, microphones, and loud-speakers (additionally described below with reference to FIG. 23).

Figure 22:
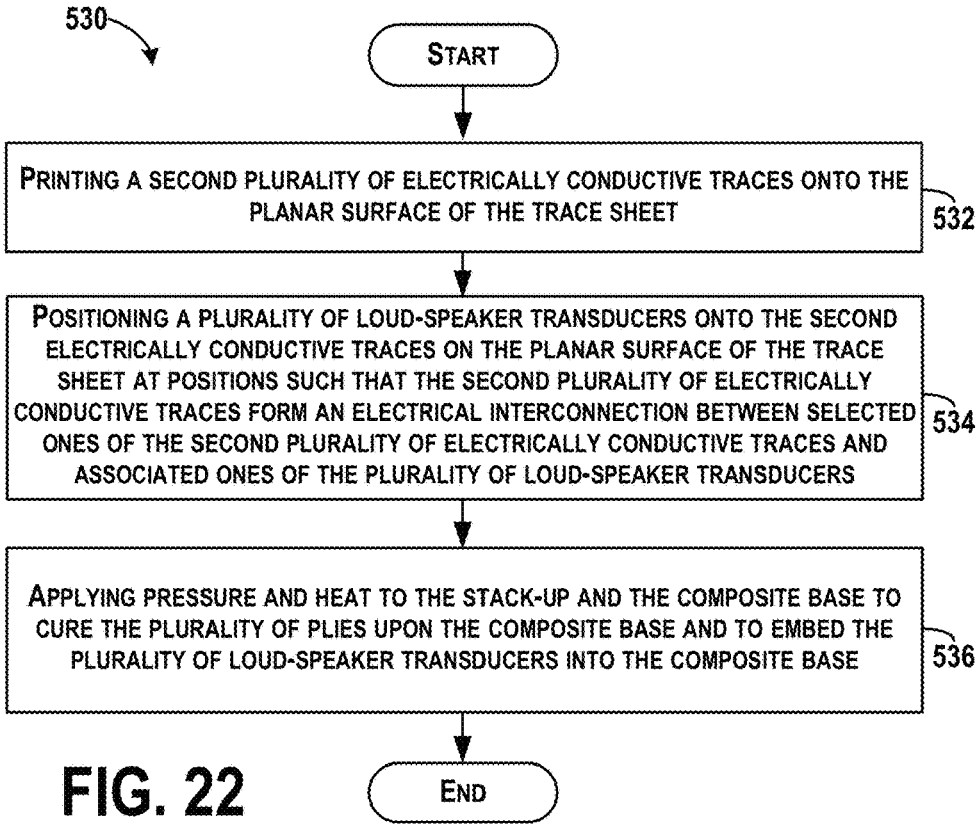
FIG. 22 shows a flowchart of yet another example method for manufacturing a composite panel, according to an example embodiment.

FIG. 22 shows a flowchart of another example method 530 for manufacturing a composite panel, according to an example embodiment. Method 530 shown in FIG. 22 presents an embodiment of a method that, for example, could be used within the processes shown in FIGS. 10-17, for example. Method 530 may include one or more operations, functions, or actions as illustrated by one or more of blocks 532-536. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

The method 530 may be performed in addition to the method 500 as described in FIG. 20 in instances in which the plurality of transducer discs 404 and 406 includes acoustic-to-electric transducers that convert sound into an electrical signal as a microphone.

At block 532, the method 530 includes printing a second plurality of electrically conductive traces 430 onto the planar surface 402 of the trace sheet 400.

At block 534, the method 530 includes positioning a plurality of loud-speaker transducers 432 and 434 onto the second plurality of electrically conductive traces 430 on the planar surface 402 of the trace sheet 400 at positions such that the second plurality of electrically conductive traces 430 form an electrical interconnection between selected ones of the second plurality of electrically conductive traces and associated ones of the plurality of loud-speaker transducers. The plurality of loud-speaker transducers 432 and 434 include electroacoustic transducers that convert an electrical audio signal into a corresponding sound as a loud-speaker.

At block 536, the method 530 includes applying pressure and heat to the stack-up 414 and the composite base 416 to cure the plurality of plies 400, 408, 410, and 412 upon the composite base 416 and to embed the plurality of loud-speaker transducers 432 and 434 into the composite base 416.

Thus, using the method 530, the composite panel can be manufactured to include both loud-speaker transducers 432 and 434 and transducer discs 404 and 406 as microphones, as shown in FIG. 17, to enable two-way communication.

Figure 23:
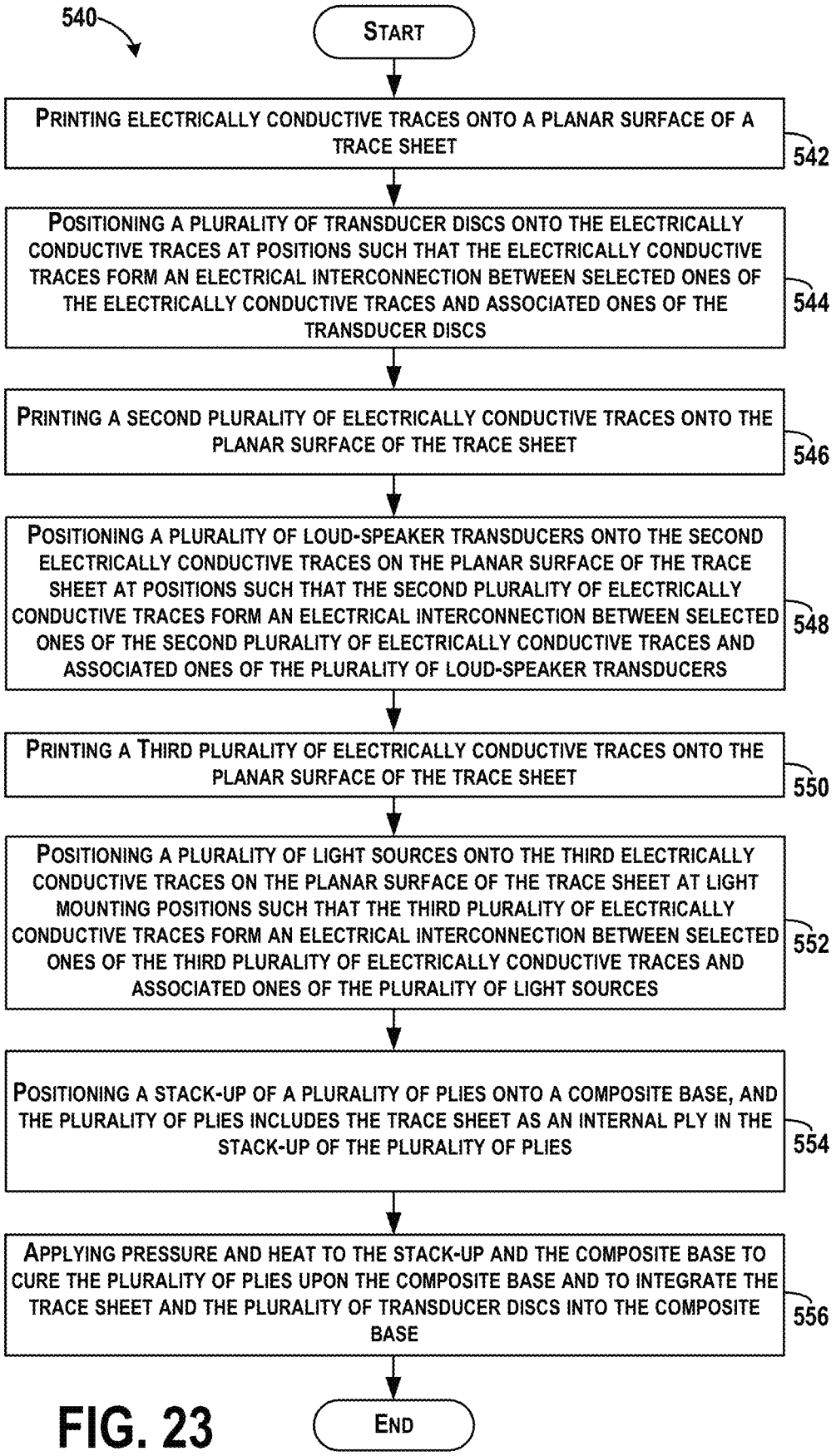
FIG. 23 shows a flowchart of yet another example method for manufacturing a composite panel, according to an example embodiment.

FIG. 23 shows a flowchart of another example method 540 for manufacturing a composite panel, according to an example embodiment. Method 540 shown in FIG. 23 presents an embodiment of a method that, for example, could be used within the processes shown in FIGS. 10-19, for example. Method 540 may include one or more operations, functions, or actions as illustrated by one or more of blocks 542-556. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

At block 542, the method 540 includes printing electrically conductive traces 204 onto a planar surface 402 of a trace sheet 400.

At block 544, the method 540 includes positioning a plurality of transducer discs 404 and 406 onto the electrically conductive traces 204 at positions such that the electrically conductive traces 204 form an electrical interconnection between selected ones of the electrically conductive traces and associated ones of the transducer discs. In this example, the plurality of transducer discs 404 and 406 include acoustic-to-electric transducers that convert sound into an electrical signal as a microphone.

At block 546, the method 540 includes printing a second plurality of electrically conductive traces 430 onto the planar surface of the trace sheet 400.

At block 548, the method 540 includes positioning a plurality of loud-speaker transducers 432 and 434 onto the second plurality of electrically conductive traces 430 on the planar surface 402 of the trace sheet 400 at positions such that the second plurality of electrically conductive traces 430 form an electrical interconnection between selected ones of the second plurality of electrically conductive traces and associated ones of the plurality of loud-speaker transducers. The plurality of loud-speaker transducers 432 and 434 include electroacoustic transducers that convert an electrical audio signal into a corresponding sound as a loud-speaker.

At block 550, the method 540 includes printing a third plurality of electrically conductive traces 440 onto the planar surface 402 of the trace sheet 400.

At block 552, the method 540 includes positioning a plurality of light sources 442 and 444 onto the third plurality of electrically conductive traces 440 on the planar surface of the trace sheet 400 at light mounting positions such that the third plurality of electrically conductive traces 440 form an electrical interconnection between selected ones of the third plurality of electrically conductive traces and associated ones of the plurality of light sources.

At block 554, the method 540 includes positioning a stack-up 414 of a plurality of plies 400, 408, 410, and 412 onto a composite base 416, and the plurality of plies 400, 408, 410, and 412 includes the trace sheet 400 as an internal ply in the stack-up 414 of the plurality of plies. One of the plurality of plies includes a polymer sheet 412, and the trace sheet 400 is provided in the stack-up 414 between the polymer sheet 412 and the composite base 416.

At block 556, the method 540 includes applying pressure and heat to the stack-up 414 and the composite base 416 to cure the plurality of plies 400, 408, 410, and 412 upon the composite base 416 and to integrate the trace sheet 400 and the plurality of transducer discs 404 and 406 as well as the loud-speaker transducers 432 and 434 and light sources 442 and 444 into the composite base 416.

Thus, using the method 540, the composite panel can be manufactured to include loud-speaker transducers 432 and 434 and transducer discs 404 and 406 as microphones, as well as light sources 442 and 444 as shown in FIG. 19.

As described above, using any of the methods in which both microphone and loud-speaker transducers are included allows for the composite panel to operate as a two-way communication device. Further, the composite panel includes the one trace sheet 400 with any combination of selected components such as the transducer discs 404 and 406 as microphones, the loud-speaker transducers 432 and 434, and the light sources 442 and 444.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A method of manufacturing a composite panel, comprising:

printing electrically conductive traces onto a planar surface of a trace sheet;

positioning a plurality of transducer discs onto the electrically conductive traces at positions such that the electrically conductive traces form an electrical interconnection between selected ones of the electrically conductive traces and associated ones of the transducer discs, wherein positioning the plurality of transducer discs onto the electrically conductive traces comprises, for each of the plurality of transducer discs: printing a bottom conductive trace onto the trace sheet, printing a piezo-electric material onto the bottom conductive trace, and printing a top conductive trace onto the piezo-electric material;

positioning a stack-up of a plurality of plies onto a composite base, wherein the plurality of plies includes the trace sheet with the printed electrically conductive traces and the plurality of transducer discs, wherein the trace sheet is included as an internal ply in the stack-up of the plurality of plies; and applying pressure and heat to the stack-up and the composite base to cure the plurality of plies upon the composite base and to integrate the trace sheet and the plurality of transducer discs into the composite base.

2. The method of claim 1, wherein the plurality of transducer discs includes acoustic-to-electric transducers that convert sound into an electrical signal.

3. The method of claim 1, wherein the plurality of transducer discs includes electroacoustic transducers that convert an electrical audio signal into a corresponding sound.

4. The method of claim 1, wherein the plurality of plies include a polymer sheet, and wherein the trace sheet is provided in the stack-up between the polymer sheet and the composite base.

5. The method of claim 1, further comprising:

printing a second plurality of electrically conductive traces onto the planar surface of the trace sheet;

positioning a plurality of light sources onto the second plurality of electrically conductive traces on the planar surface of the trace sheet at light mounting positions such that the second plurality of electrically conductive traces form an electrical interconnection between selected ones of the second plurality of electrically conductive traces and associated ones of the plurality of light sources; and applying pressure and heat to the stack-up and the composite base to cure the plurality of plies upon the composite base and to embed the plurality of light sources into the composite base.

6. The method of claim 1, wherein the plurality of transducer discs includes acoustic-to-electric transducers that convert sound into an electrical signal as a microphone, and the method further comprises:

printing a second plurality of electrically conductive traces onto the planar surface of the trace sheet;

positioning a plurality of loud-speaker transducers onto the second plurality of electrically conductive traces on the planar surface of the trace sheet at positions such that the second plurality of electrically conductive traces form an electrical interconnection between selected ones of the second plurality of electrically conductive traces and associated ones of the plurality of loud-speaker transducers, wherein the plurality of loud-speaker transducers include electroacoustic transducers that convert an electrical audio signal into a corresponding sound as a loud-speaker; and applying pressure and heat to the stack-up and the composite base to cure the plurality of plies upon the composite base and to embed the plurality of loud-speaker transducers into the composite base.

7. The method of claim 1, wherein the composite base includes a honeycomb core panel.

8. The method of claim 1, wherein the composite base includes a polycarbonate material.

9. A method of manufacturing a composite panel, comprising:

printing electrically conductive traces onto a planar surface of a trace sheet;

positioning a plurality of transducer discs onto the electrically conductive traces at positions such that the electrically conductive traces form an electrical interconnection between selected ones of the electrically conductive traces and associated ones of the transducer discs;

printing a second plurality of electrically conductive traces onto the planar surface of the trace sheet;

positioning a plurality of light sources onto the second plurality of electrically conductive traces on the planar surface of the trace sheet at light mounting positions such that the second plurality of electrically conductive traces form an electrical interconnection between selected ones of the second plurality of electrically conductive traces and associated ones of the plurality of light sources;

positioning a stack-up of a plurality of plies onto a composite base, wherein the plurality of plies includes the trace sheet with the printed electrically conductive traces and the plurality of transducer discs and with the printed second plurality of electrically conductive traces and the plurality of light sources, wherein the trace sheet is included as an internal ply in the stack-up of the plurality of plies;

applying pressure and heat to the stack-up and the composite base to cure the plurality of plies upon the composite base and to integrate the trace sheet and the plurality of transducer discs into the composite base as well as to embed the plurality of light sources into the composite base.

10. The method of claim 9, wherein the plurality of transducer discs includes piezo-electric microphone components printed on the trace sheet.

11. The method of claim 9, wherein the plurality of transducer discs include acoustic-to-electric transducers.

12. The method of claim 9, wherein the composite base includes a honeycomb core panel.

13. The method of claim 9, wherein positioning the stack-up of the plurality of plies onto the composite base comprises positioning a polymer sheet, and wherein the trace sheet is provided in the stack-up between the polymer sheet and the composite base.

14. The method of claim 9, wherein the trace sheet includes the electrically conductive traces and the plurality of transducer discs printed thereon.

15. A method of manufacturing a composite panel, comprising:

printing electrically conductive traces onto a planar surface of a trace sheet;

positioning a plurality of transducer discs onto the electrically conductive traces at positions such that the electrically conductive traces form an electrical interconnection between selected ones of the electrically conductive traces and associated ones of the transducer discs, wherein the plurality of transducer discs includes acoustic-to-electric transducers that convert sound into an electrical signal as a microphone;

printing a second plurality of electrically conductive traces onto the planar surface of the trace sheet;

positioning a plurality of loud-speaker transducers onto the second plurality of electrically conductive traces on the planar surface of the trace sheet at positions such that the second plurality of electrically conductive traces form an electrical interconnection between selected ones of the second plurality of electrically conductive traces and associated ones of the plurality of loud-speaker transducers, wherein the plurality of loud-speaker transducers include electroacoustic transducers that convert an electrical audio signal into a corresponding sound as a loud-speaker;

positioning a stack-up of a plurality of plies onto a composite base, wherein the plurality of plies includes the trace sheet with the printed electrically conductive traces and the plurality of transducer discs and with the printed second plurality of electrically conductive traces and the plurality of loud-speaker transducers, wherein the trace sheet is included as an internal ply in the stack-up of the plurality of plies; and applying pressure and heat to the stack-up and the composite base to cure the plurality of plies upon the composite base and to integrate the trace sheet and the plurality of transducer discs into the composite base as well as to embed the plurality of loud-speaker transducers into the composite base.

16. The method of claim 15, wherein the plurality of plies include a polymer sheet, and wherein the trace sheet is provided in the stack-up between the polymer sheet and the composite base.

17. The method of claim 15, wherein the composite base includes a honeycomb core panel.

18. The method of claim 15, wherein the composite base includes a polycarbonate material.

19. The method of claim 15, wherein the plurality of transducer discs includes piezo-electric microphone components printed on the trace sheet.

20. The method of claim 15, wherein the trace sheet includes the electrically conductive traces and the plurality of transducer discs printed thereon.

* * * * *